US008328177B2

(12) United States Patent
Claris

(10) Patent No.: US 8,328,177 B2
(45) Date of Patent: Dec. 11, 2012

(54) FEED DEVICE WITH IMPROVED GRIP

(75) Inventor: Yannick Claris, Fontenay Aux Roses (FR)

(73) Assignee: Neopost Technologies, Bagneux (FR)

( * ) Notice: Subject to any disclaimer, the term of this patent is extended or adjusted under 35 U.S.C. 154(b) by 343 days.

(21) Appl. No.: 12/837,034

(22) Filed: Jul. 15, 2010

(65) Prior Publication Data

US 2011/0014025 A1 Jan. 20, 2011

(30) Foreign Application Priority Data

Jul. 20, 2009 (FR) ..... 09 55042

(51) Int. Cl.
*B65H 5/00* (2006.01)

(52) U.S. Cl. ..... 271/2; 271/248; 193/37; 492/28; 492/38

(58) Field of Classification Search ..... 271/2, 248; 193/37; 492/28, 38
See application file for complete search history.

(56) References Cited

U.S. PATENT DOCUMENTS

| | | | | |
|---|---|---|---|---|
| 3,955,342 | A * | 5/1976 | Johnson et al. | 53/377.2 |
| 4,015,843 | A * | 4/1977 | Tennant | 271/240 |
| 4,973,037 | A * | 11/1990 | Holbrook | 271/2 |
| 4,982,942 | A * | 1/1991 | Konishi et al. | 271/119 |
| 5,112,037 | A * | 5/1992 | Holbrook | 271/2 |
| 5,267,008 | A * | 11/1993 | Rebres et al. | 399/388 |
| 5,297,785 | A | 3/1994 | Ricciardi | |
| 5,597,155 | A * | 1/1997 | Guido et al. | 271/119 |
| 5,657,983 | A * | 8/1997 | Fisk | 271/251 |
| 5,767,452 | A * | 6/1998 | Yankloski | 177/25.11 |
| 5,954,324 | A * | 9/1999 | Rehberg et al. | 271/2 |
| 6,050,054 | A | 4/2000 | Van Lierde et al. | |
| 7,664,923 | B2 * | 2/2010 | Kim et al. | 711/162 |
| 7,744,082 | B2 * | 6/2010 | Iwami et al. | 271/119 |
| 7,810,807 | B2 * | 10/2010 | Liebheit | 271/238 |
| 2007/0052154 | A1 | 3/2007 | Mitsuya et al. | |

FOREIGN PATENT DOCUMENTS

| | | |
|---|---|---|
| EP | 0 856 483 A1 | 8/1998 |
| EP | 1 544 140 A2 | 6/2005 |
| EP | 1 762 515 A2 | 3/2007 |

* cited by examiner

*Primary Examiner* — Kaitlin Joerger
*Assistant Examiner* — Ernesto Suarez
(74) *Attorney, Agent, or Firm* — Sughrue Mion, PLLC

(57) ABSTRACT

A mailpiece feed device comprising a mailpiece-receiving deck for receiving a stack of mailpieces, conveyor rollers for conveying the mailpieces along a longitudinal referencing wall and towards a separator device designed to separate the mailpieces one-by-one from said stack of mailpieces and to convey them downstream, and, incorporated vertically in said longitudinal referencing wall, at least one friction roller of varying roughness, with its coefficient of friction decreasing from the top to the bottom of said longitudinal referencing wall.

12 Claims, 1 Drawing Sheet

FEED DEVICE WITH IMPROVED GRIP

TECHNICAL FIELD

The present invention relates to the field of mail handling, and it relates more particularly to an automatic feed module, or feeder, of a mailpiece franking machine or "postage meter".

PRIOR ART

Conventionally, a franking machine must be adapted to receive various types of mailpieces, such as documents, letters, or envelopes of various thicknesses, typically in the range 0.1 millimeters (mm) to 20 mm. For this purpose, on the upstream side, it is often provided with an automatic feed module, such as the feed module described in Patent EP 0 856 483 granted to the Applicant, making it possible, in particular, to convey the mailpieces at various speeds, and usually including means for receiving/stacking, selecting, conveying, and possibly closing said mailpieces.

Selection is generally performed by a single guide and the force with which that guide presses against the mailpieces determines the quality of selection. For mailpieces of small thickness, typically less than 6 mm, that force must be large so as to limit bunching, i.e. so as to limit the number of occasions mailpieces pass through together rather than singly, whereas that force can be small for mailpieces of larger thickness. Such bunching is highly detrimental because it gives rise both to over-invoicing of one of the mailpieces (two mailpieces are weighed instead of a single mailpiece), and also to the underlying mailpiece not being franked and to the overlying mailpiece not being closed. Unfortunately, since the guide is pressed against the mailpiece by a compression spring so as to prevent such bunching, mailpieces of large thickness, and more particularly such mailpieces that have windows, might be damaged or torn.

In addition, the quality of selection is also related to how the mailpieces are presented to the guide because the larger the number of mailpieces having their leading edges in contact with said guide, the lower the effectiveness with which a single one of them is selected.

OBJECT AND DEFINITION OF THE INVENTION

An object of the present invention is to mitigate the drawbacks resulting from mailpiece bunching by proposing a franking machine feeder that makes it possible for the mailpieces to be presented in a novel manner to the guide, namely staggered relative thereto in a backwardly leaning stack, so as to facilitate subsequent selection of said mailpieces.

These objects are achieved by a mailpiece feed device comprising a mailpiece-receiving deck for receiving a stack of mailpieces, conveyor rollers for conveying the mailpieces along a longitudinal referencing wall and towards a separator device designed to separate the mailpieces one-by-one from said stack of mailpieces and to convey them downstream, wherein, incorporated vertically in said longitudinal referencing wall, said mailpiece feed device further comprises at least one friction roller of varying roughness, with its coefficient of friction decreasing from the top to the bottom of said longitudinal referencing wall.

By means of this specific structure of the longitudinal referencing wall, bunching is systematically avoided and, by putting the first mailpieces in the stack into a staggered configuration in which the stack leans backwards, the work for selecting the mailpieces one-by-one is greatly facilitated. In addition, the quality of selection is improved when selecting fine envelopes.

Advantageously, said at least one friction roller has a length not less than the height of an insertion slot in said selector device.

Depending on the embodiment, said roughness varies linearly or in successive stages of constant roughness.

Said at least one friction roller may be replaced with a plurality of superposed friction rollers, each of which has a constant and different roughness.

Said at least one friction roller may be made of natural gum arabic, or of silicone that has been subjected to a plurality of rectification operations in order to obtain said varying roughness, or indeed of a ceramic material whose grain size varies so as to obtain said varying roughness.

Preferably, said at least one friction roller has a roughness-free vertical zone defining a smooth vertical strip.

Advantageously, when the feed device does not have any manual jogging means, said mailpiece-receiving deck is inclined towards said longitudinal referencing wall.

Depending on the embodiment, said at least one friction roller is mounted to be free to rotate while being an almost exact fit on the shaft about which it rotates, or it is motor-driven by motor-drive means disposed in alignment with the shaft that rotates said at least one friction roller and in direct engagement therewith, or it is motor-driven by common motor-drive means connected via a drive train of the cog and chain type to a shaft that rotates said at least one friction roller, or indeed it is motor driven via a suitable drive train by motor-drive means for driving said conveyor rollers.

BRIEF DESCRIPTION OF THE DRAWING

Other characteristics and advantages of the present invention appear more clearly from the following description given by way of non-limiting indication, with reference to the accompanying drawings, in which.

DETAILED DESCRIPTION OF A PREFERRED EMBODIMENT OF THE INVENTION

Figure 1:
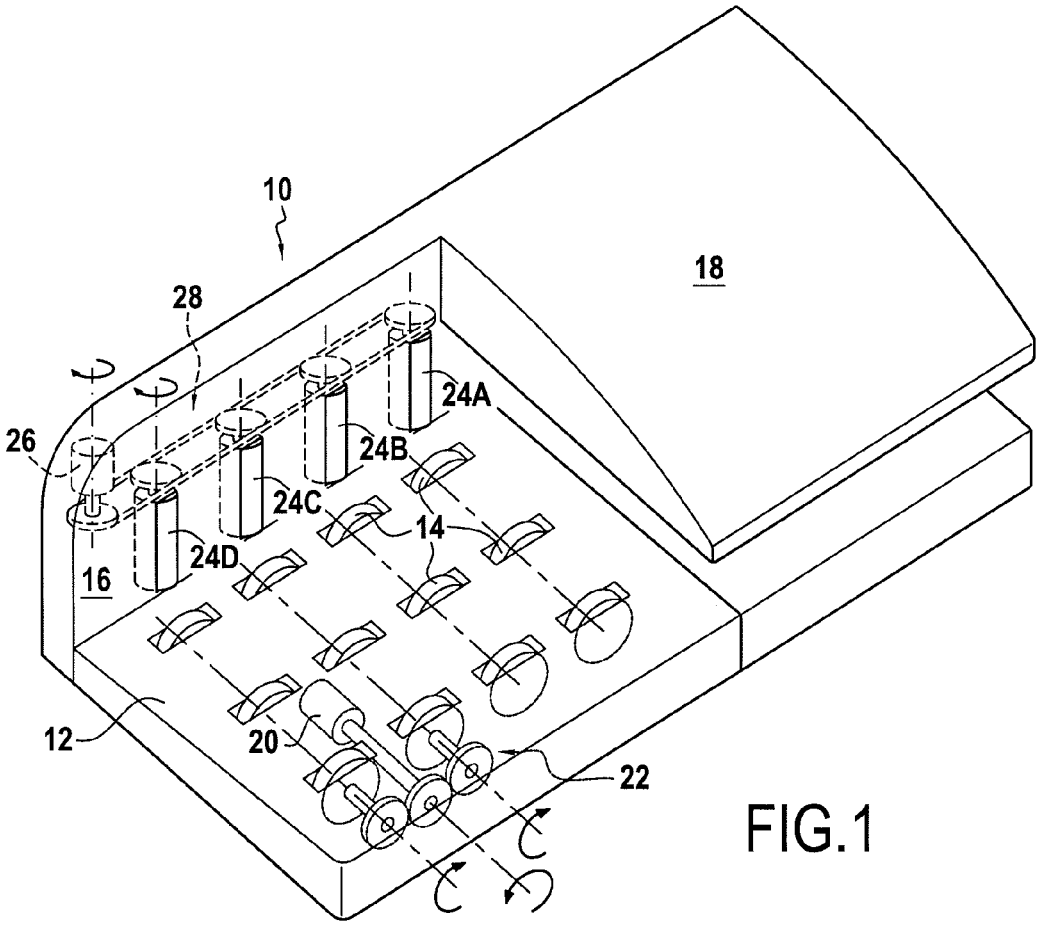
FIG. 1 is a perspective view of a mailpiece feed device of the invention.

An automatic mailpiece feed module 10 of the invention is shown in FIG. 1. Conventionally, such a feed module for a franking machine has a feed zone that is formed essentially of a mailpiece-receiving bed 12 designed to receive a stack of mailpieces and provided with conveyor rollers 14 for driving said mailpieces downstream (and along a longitudinal referencing wall 16) to a separation and conveying zone including a separator device 18 in which said mailpieces are extracted one-by-one from the stack of articles and are then conveyed downstream by other conveyor rollers (not shown) that are, in general, disposed at the outlet of said separation zone. The conveyor rollers are actuated by first motor-drive means 20 via a suitable drive train 22.

The separator device conventionally includes a hinged guide mounted to pivot against resilient means and co-operating with a plurality of opposing selection rollers to select a single mailpiece on its own and to convey it downstream via said other conveyor rollers. The guide is in general inclined downstream and is comb-shaped so as to guarantee the best possible contact with the selected mailpiece.

In accordance with the invention, the feeder further includes at least one friction roller 24A, 24B, 24C, 24D that is incorporated vertically into the referencing wall 16 and that is caused to rotate by second motor-drive means 26 in a direction opposite to the direction of the conveyor rollers 14, i.e. opposite to the direction of advance of the mailpieces so as to increase the friction force thereon. When only one motor-driven friction roller is provided, said friction roller is advantageously disposed in register with the first row of conveyor rollers (i.e. the row closest to the selector device) and the motor-drive means are preferably disposed in alignment with the shaft that rotates said roller, and thus in direct engagement therewith. Conversely, when at least two friction rollers are provided, the motor-drive means are preferably common and connected to the shaft that rotates each of the rollers via a suitable drive train, such as, for example, the drive train of the cog and chain type 28 shown.

It is also possible to use the first motor-drive means 20 for also actuating the friction roller(s) by then implementing another suitable drive train and additional reducing gear means between the drive train 22 controlling the conveyor rollers 14 and the drive train 28 controlling the friction rollers 24, since the speed of rotation of the friction rollers is particularly low compared with the speed of rotation of the conveyor rollers.

However, it should be noted that it is not an essential characteristic for the friction rollers to be motor-driven, and operation that is also quite satisfactory, even though it might offer lower performance, is possible with rollers merely mounted to be free to rotate while being braked slightly as they rotate by being almost exact fits on the shafts about which they rotate.

The length (height) of the friction roller(s) is no less than the height (typically 20 mm) of the slot via which the mailpieces are inserted, and the roughness of said friction roller(s) varies, with its coefficient of friction decreasing from the top of the roller to its base, so that, when the mailpieces are jogged against the referencing wall 16, the mailpieces at the bottom of the stack are braked to a lesser extent as they advance than the mailpieces at the top, thereby forming the desired staggered backwardly leaning stack configuration, the jogging being achieved, for example, merely by the mailpiece-receiving deck 12 being inclined towards said referencing wall (e.g. at an angle of inclination of about 10°), or by means of a manual jogger device (not shown).

Figure 2A:
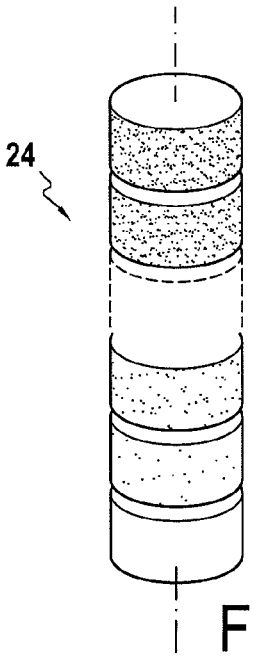
FIG. 2A shows a first variant embodiment of a friction roller of FIG. 1.

The roughness preferably varies linearly, but it may also vary in successive stages of constant roughness, e.g. in stages of 2 mm, the standard thickness of a mailpiece in general lying in the range 2 mm to 6 mm. In this configuration, it is possible to replace the large 20-mm friction roller with ten superposed small friction rollers, each of which is of constant and different roughness as shown in FIG. 2A.

The friction roller may be made of natural gum arabic that has undergone a plurality of rectification operations in order to obtain a coefficient of friction that varies linearly or in stages, or indeed it may be made of a ceramic material such as titanium oxide with grain size that varies linearly or in stages. Instead of natural gum arabic, it is also possible to use a silicone rubber or an ethylene propylene diene monomer (EPDM).

Figure 2B:
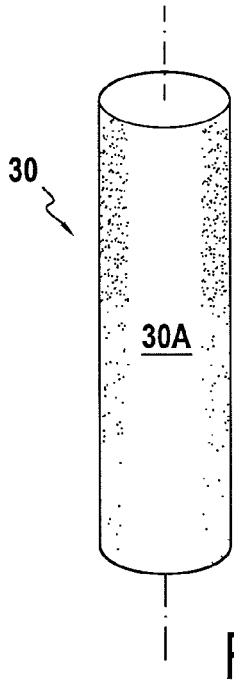
FIG. 2B shows a second variant embodiment of a friction roller of FIG. 1.

A variant embodiment of the friction roller is shown in FIG. 2B. In this variant, more particularly implemented when the mailpiece-receiving deck is inclined, the roller 30 has a zero-roughness zone 30A that defines a smooth vertical strip along which the coefficient of friction of the roller is zero so that no mailpiece can cling to it. It should be noted that such a zone may also result from absence of granularity when a granular ceramic material is used.

The automatic feed device of the invention operates as follows. With the mailpieces to be handled being dumped in no particular manner on the mailpiece-receiving deck 12 and being jogged against the longitudinal referencing wall 16, when the conveyor rollers 14 are caused to operate the stack of mailpieces is driven downstream, but the movement of the stack is braked by the friction rollers, which are free to rotate but in braked manner or which are motor-driven so that they rotate in the opposite direction, and rub against the longitudinal edges of the mailpieces. More particularly, the conveyor rollers 14 deliver most downstream drive to the mailpiece that is immediately above them (the first mailpiece at the bottom of the stack) and that is not subjected to the roughness of the friction rollers over the first two millimeters, then to the second that is subjected to higher roughness, and then to the third that is subjected to even higher roughness, and so on. Thus, by the action of the friction rollers of varying roughness that increases from the bottom to the top of the stack, the mailpieces that are moved necessarily find themselves staggered in a backwardly leaning stack, the bottom mailpiece in direct contact with the conveyor rollers finding itself the furthest forward on the mailpiece-receiving deck and thus the best placed for coming into engagement with the guide, thereby avoiding, by construction, any bunching.

When the mailpiece-receiving deck is inclined, and due to the roughness of the friction rollers, it is possible for the mailpieces that have not yet been selected to remain clinging to the reference wall and not to fall fast enough onto the mailpiece-receiving deck, thereby making it impossible for them to be driven again. That is why the smooth strip 30A is provided since, by forming a roughness-free zone on each revolution of the roller, said strip enables the mailpieces to remain in contact with the conveyor rollers.

What is claimed is:

1. A mailpiece feed device comprising:

a mailpiece-receiving deck for receiving a stack of mailpieces;

conveyor rollers for conveying the stack of mailpieces along a longitudinal referencing wall and towards a separator device;

the separator device configured to separate the mailpieces one-by-one from said stack of mailpieces and to convey them downstream;

wherein, said mailpiece feed device further includes at least one friction roller of varying roughness incorporated vertically in said longitudinal referencing wall, said at least one friction roller has a surface coefficient of friction decreasing from the top to the bottom of said longitudinal referencing wall in an axial direction of the at least one friction roller.

2. A mailpiece feed device according to claim 1, wherein said at least one friction roller has a length not less than the height of an insertion slot in said mailpiece feed device.

3. A mailpiece feed device according to claim 1, wherein said roughness varies linearly or in successive stages of constant roughness.

4. A mailpiece feed device according to claim 1, wherein said at least one friction roller includes a plurality of superposed friction rollers, each of which has a constant and different roughness.

5. A mailpiece feed device according to claim 1, wherein said at least one friction roller is made of natural gum arabic or of silicone that has been subjected to a plurality of rectification operations in order to obtain said varying roughness.

6. A mailpiece feed device according to claim 1, wherein said at least one friction roller is made of a ceramic material whose grain size varies so as to obtain said varying roughness.

7. A mailpiece feed device according to claim 1, wherein said at least one friction roller has a roughness-free vertical zone defining a smooth vertical strip.

8. A mailpiece feed device according to claim 1, wherein said mailpiece-receiving deck is inclined towards said longitudinal referencing wall.

9. A mailpiece feed device according to claim 1, wherein said at least one friction roller is mounted to be free to rotate while being an almost exact fit on the shaft about which it rotates.

10. A mailpiece feed device according to claim 1, wherein said at least one friction roller is motor-driven by motor-drive means disposed in alignment with the shaft that rotates said at least one friction roller and in direct engagement therewith.

11. A mailpiece feed device according to claim 1, wherein said at least one friction roller is motor-driven by common motor-drive means connected via a drive train of the cog and chain type to a shaft that rotates said at least one friction roller.

12. A mailpiece feed device according to claim 1, wherein said at least one friction roller is motor driven via a suitable drive train by motor-drive means for driving said conveyor rollers.

* * * * *